United States Patent [19]

Florio et al.

[11] 3,989,023

[45] Nov. 2, 1976

[54] TRIGGERING ROTOR AND SENSOR ASSEMBLY

[75] Inventors: Sam A. Florio, Oregon; Norman F. Sieja, Toledo, both of Ohio

[73] Assignee: Eltra Corporation, Toledo, Ohio

[22] Filed: June 7, 1974

[21] Appl. No.: 477,396

[52] U.S. Cl. ..... 123/146.5 A; 123/148 E; 200/19 M; 310/70 R

[51] Int. Cl.[2] ..... F02P 3/02

[58] Field of Search..... 123/148 E, 148 R, 148 DK, 123/146.5 A, 146.5 R; 200/19 M, 19 R, 19 A, 31 DP; 310/70 R, 70 A; 315/209 R

[56] References Cited

UNITED STATES PATENTS

| | | | |
|---|---|---|---|
| 2,133,413 | 10/1938 | Arthur | 200/19 A |
| 2,291,652 | 8/1942 | Rose | 200/19 M |
| 2,889,418 | 6/1959 | Kline | 200/19 R |
| 3,254,247 | 5/1966 | Falge | 200/19 M X |
| 3,272,930 | 9/1966 | Frank | 200/19 M |
| 3,299,876 | 1/1967 | Mieras | 315/209 R |
| 3,327,164 | 6/1967 | Steinberg et al. | 315/209 R X |
| 3,373,729 | 3/1968 | Lemen | 315/209 R X |
| 3,447,004 | 5/1969 | Falge | 310/70 R |
| 3,906,920 | 9/1975 | Hemphill | 123/146.5 A |

*Primary Examiner*—Charles J. Myhre
*Assistant Examiner*—Tony M. Argenbright
*Attorney, Agent, or Firm*—Robert H. Johnson

[57] ABSTRACT

A distributor for use with an electronic breakerless ignition system. The distributor has a triggering rotor and a triggering sensor which are connected by a bearing to form a single assembly so that the radial spacing between the rotor and sensor remains constant regardless of any variation in the axis of rotation of the rotor.

5 Claims, 8 Drawing Figures

TRIGGERING ROTOR AND SENSOR ASSEMBLY

BACKGROUND OF THE INVENTION

The field of art to which this invention relates includes electronic ignition systems, and more specifically the triggering of breakerless systems.

As the use and acceptance of electronic ignition systems increases, a demand for a kit to convert a conventional automotive ignition system to an electronic breakerless ignition system has developed. Such a kit must be suitable for use not only with automobiles that have accumulated low mileage, but also automobiles that have accumulated substantial mileage and the resultant wear. Further, such a kit must be easily installed by persons other than skilled mechanics. One of the problems with providing such a kit lies in the provision of a suitable triggering assembly.

Therefore, it is a principal object of our invention to provide a one-piece triggering assembly which is substantially insensitive to distributor shaft wobble and replaces the breaker contact set in a conventional distributor.

SUMMARY OF THE INVENTION

In carrying out our invention in a preferred embodiment, there is provided a triggering rotor adapted to be mounted on the breaker cam in a distributor for conjoint rotation. A generally cylindrical sensor which cooperates with the rotor to actuate the associated ignition system to provide a high voltage spark discharge is fixed to a plate. The plate is adapted to be connected to a vacuum actuated timing adjustment mechanism and is connected to the rotor for relative rotation and supported therefrom by a bearing.

The above and other objects, features and advantages of our invention will be more easily understood by persons skilled in the art when the detailed description is taken in conjunction with the drawing.

DESCRIPTION OF THE PREFERRED EMBODIMENT

Figure 1:
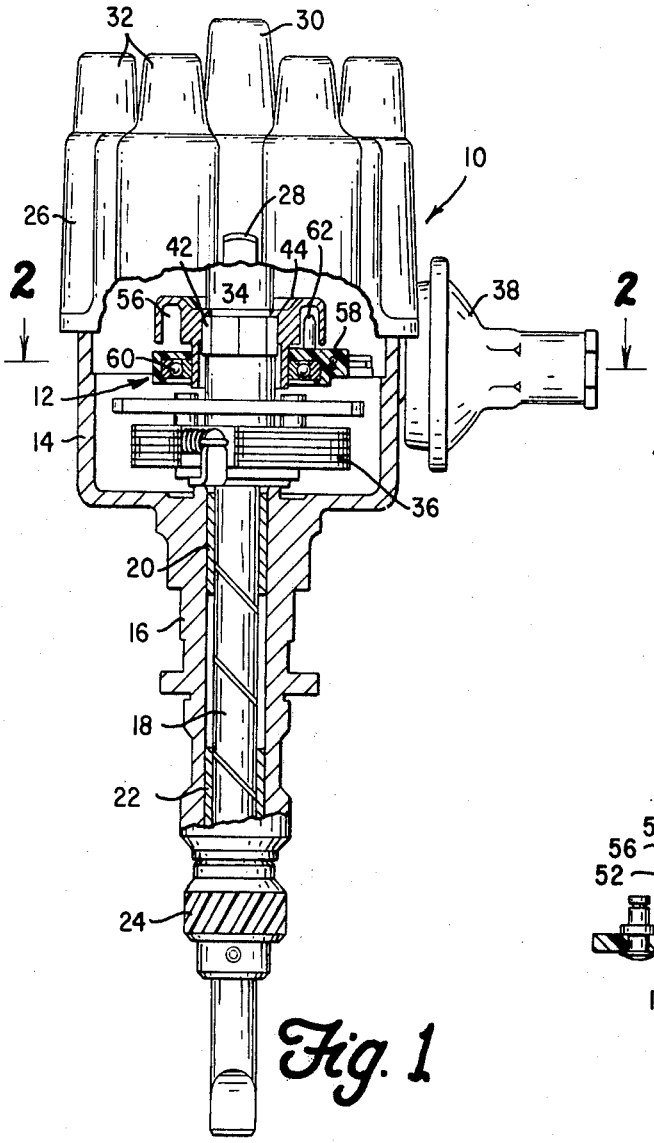
FIG. 1 is an elevational view partially in section of a distributor embodying our invention.
Figure 2:
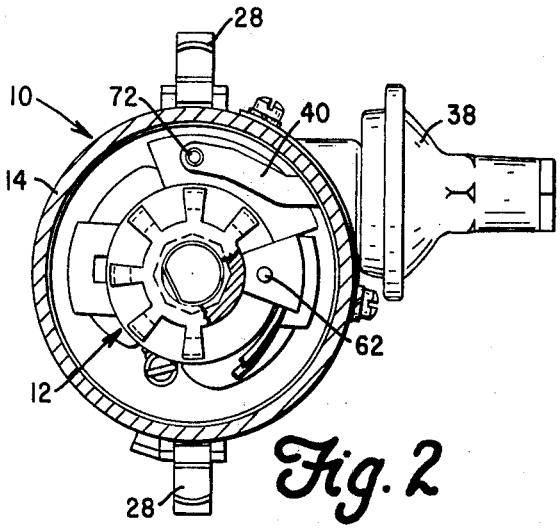
FIG. 2 is a partial sectional view taken along line 2—2 of FIG. 1.

Referring now to FIGS. 1 and 2, the reference numeral 10 denotes a conventional distributor which has been modified by having the breaker contact set removed and replaced with our one-piece triggering rotor and sensor assembly 12 so that the distributor is suitable for use with an electronic breakerless ignition system such as disclosed in U.S. Pat. No. 3,316,448.

Distributor 10 includes a cup-shaped body 14 which includes a tubular projection 16 that is adapted to be affixed to an engine block and in which a drive shaft 18 is journaled by means of a pair of bushings 20 and 22. Fixed to shaft 18 is a gear 24 which is adapted to mesh with an engine-driven gear so that shaft 18 is driven at a speed proportional to engine speed.

Distributor 10 also includes a plastic cover 26 which is removably attached to body 14 by means of spring clamps 28. Cover 26 is conventional and includes a receptacle 30 for receiving the high voltage lead from the ignition coil and a plurality of receptacles 32 for receiving one end of the spark plug ignition leads.

Telescoped on the upper end of shaft 18 is a sleeve shaft 34 which includes a breaker cam 42. Shaft 34 is connected to shaft 18 by means of a centrifugal timing adjustment mechanism 36 which will not be described in detail since it does not form a part of the present invention and, furthermore, is commonly understood and well known in this art. Suffice it to say merely that as the speed of shaft 18 increases, mechanism 36 causes sleeve shaft 34 to rotate to a position relative to shaft 18 which is related to speed so that the timing of the firing of the associated ignition system will be advanced as engine speed increases.

Distributor 10 also is provided with a vacuum-actuated timing adjustment mechanism 38 which is operable in response to varying engine vacuum. Mechanism 38 includes an arm 40 which is adapted to be connected to assembly 12 as will be explained in more detail hereinafter and functions to advance the ignition timing as the engine vacuum increases. Timing mechanism 38 is conventional, and so will not be described in detail.

Figure 3:
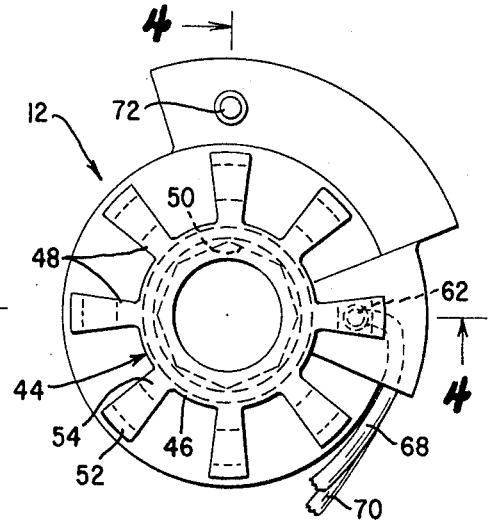
FIG. 3 is a plan view on an enlarged scale of our one-piece triggering rotor and sensor assembly.
Figure 4:
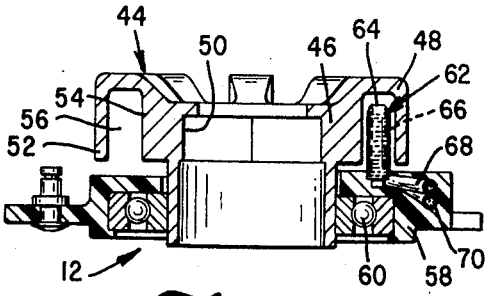
FIG. 4 is a cross-section taken along line 4—4 of FIG. 3.
Figure 5:
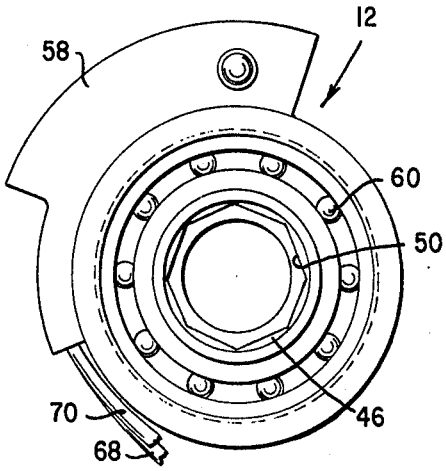
FIG. 5 is a bottom view of the assembly shown in FIG. 3.

Referring now to FIGS. 3, 4 and 5, it will be seen that assembly 12 includes a triggering rotor 44. Rotor 44 has a hub 46 from which a plurality of arms 48 extend. Extending through hub 46 is a bore 50, a portion of which conforms to the shape of breaker cam 42. As a result rotor 44 can be mounted on shaft 34 for conjoint rotation therewith. Each arm 48 of rotor 44 has a generally inverted U-shape so that the legs 52 and 54 define a space 56 therebetween.

Assembly 12 also includes a plate 58 which is generally annular in shape and which is rotatably connected to and supported from rotor 44 by means of a ball bearing 60. Mounted on plate 58 is a triggering sensor 62 which includes a vertical upstanding ferrite stud 64 which carries a coil 66 that is connectable to the associated ignition system by a pair of leads 68 and 70. Also mounted on plate 58 is a post 72 which provides a pivotal connection with arm 40 of timing mechanism 38. At this point it will be noted that triggering sensor 62 is disposed so that it intercepts space 56 between the legs 52 and 54 of each arm 48 as rotor 44 rotates relative to sensor 62. It will be seen that the pivotal connection of post 72 to arm 40 also serves to prevent rotation of plate 58, and thus triggering sensor 62.

It will now be appreciated that a conventional distributor of the type shown in FIG. 1 can be readily converted for use with an electronic breakerless ignition system simply by removing the breaker point plate assembly and all parts mounted thereon and replacing it with the one-piece assembly 12 by dropping it over shaft 34 so that bore 50 engages breaker cam 42. The entire assembly 12 will then be supported by shaft 34 and rotor 44 will be connected to shaft 34 for conjoint rotation therewith. Arm 40 of timing mechanism 38 is then slipped over post 72 to engage it and leads 68 and 70 are connected to the associated electronic ignition system, thereby completing the conversion and installation. At this point the ease of installation for a person other than a skilled mechanic should be obvious.

As shaft 18 drives shaft 34 so that triggering rotor 44 is rotated in a clockwise direction, as viewed in FIG. 2, the legs 52 and 54 of arms 48 bracket the sensor 62 as they sweep past it during rotation of rotor 44. Sensor 62 creates an electromagnetic field which surrounds it, and so as legs 52 and 54 move past sensor 62 on each side thereof, they intercept portions of the electromagnetic field. This changes the "Q" or quality of the electromagnetic field which in turn influences the electrical circuit of which sensor 62 is a part. The associated ignition system is designed so that the change in Q of the electromagnetic field which occurs when the leading edge of each arm 48 is substantially in line with the longitudinal center line of sensor 62 will cause the associated ignition system to fire or discharge a high voltage spark. It will be understood that the effect of legs 52 and 54 on the Q of the electromagnetic field depends on the area of the field of which legs 52 and 54 intercept and on the spatial relation of legs 52 and 54 to sensor 62. This particular type of rotor is disclosed in more detail and claimed in a copending patent application, Ser. No. 477,395, filed June 7, 1974, now abandoned.

The advantage of using a rotor of the type shown is that in fabrication of assembly 12 the radial spacing of sensor 62 relative to rotor 44 and variation in spaces 56 are not as critical due to the self-compensating feature of this particular type rotor.

During use a distributor of the type shown in FIG. 1 incurs wear at bearings 20 and 22. Such wear produces what is termed "shaft run out." That is, shaft 18 no longer rotates on a fixed axis, but rather on an axis which moves about, within limits. Such run out of shaft 18 is undesirable in a triggering mechanism utilizing a rotor and a sensor because even very slight variations in spatial relationship of the rotor to the triggering sensor will change the point at which firing of the ignition system occurs, and thus cause erratic firing of the ignition system which would be unacceptable. While the self-compensation feature of rotor 44 can ameliorate the problem causes by shaft run out, our assembly 12 is not sensitive to run out of shaft 18 because plate 58, and hence sensor 62, is connected to rotor 44 by means of bearing 60 with the result that any run out of shaft 18 is transmitted to sensor 62. Consequently, the radial relationship of sensor 62 relative to rotor 44 remains constant throughout rotation of shaft 18 with the result that uniform firing of the associated ignition system is assured even though there is run out of shaft 18.

Figure 6:
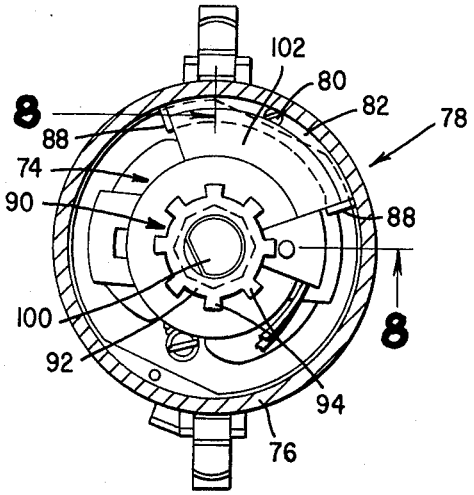
FIG. 6 is a view similar to FIG. 2 of a modification of our invention.
Figure 7:
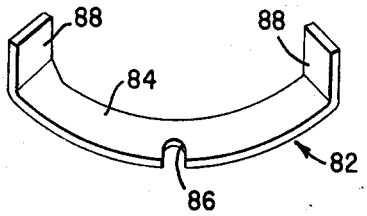
FIG. 7 is an isometric view of a retaining bracket used in the embodiment of our invention shown in FIG. 6
Figure 8:
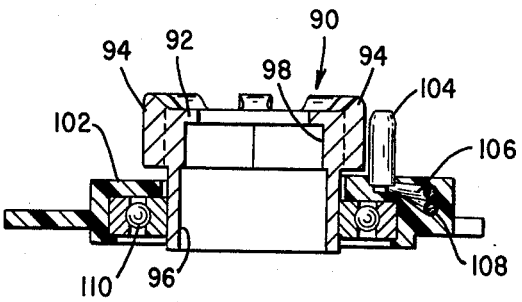
FIG. 8 is a cross-section of the triggering rotor and sensor assembly taken along line 8—8 of FIG. 6.

Turning now to FIGS. 6, 7 and 8, another embodiment of our invention will be described. A one-piece triggering rotor and sensor assembly 74 is shown disposed in the body 76 of a conventional distributor 78 which is otherwise similar to distributor 10, except that it is not provided with a vacuum-actuated timing adjustment mechanism. Connected to body 76 of the distributor by means of a machine screw 80 is an anchor 82 which is generally U-shaped and includes an arcuate bight portion 84 with a slot 86 therein which receives machine screw 80 and a pair of upstanding legs 88.

Assembly 74 includes a rotor 90 with a hub 92 from which a plurality of arms 94 extend. Hub 92 includes a bore 96 with a portion 98 which conforms to the shape of the breaker cam of distributor 78 so that rotor 90 can be mounted on a sleeve shaft 100 of distributor 78 for conjoint rotation therewith.

Assembly 74 includes a generally annular plate 102 which engages legs 88, and so is held from rotation, but is permitted some limited radial movement due to shaft run out. Carried by plate 102 is a triggering sensor 104 which is identical to sensor 62 and which is adapted to be connected to an associated electronic ignition system by means of leads 106 and 108.

Plate 102, and hence sensor 104, is rotatably connected to and supported from rotor 90 by a ball bearing 110. The result is a one-piece assembly 78 in which the spatial relation of sensor 104 to rotor 90 is maintained constant regardless of shaft run out due to the wear of the shaft bearings.

As triggering rotor 90 is rotated in a clockwise direction, as viewed in FIG. 6, the arms 94 sweep past sensor 104. Sensor 104 creates an electromagnetic field which surrounds it, and so as arms 94 move past sensor 104, they intercept portions of the electromagnetic field. This changes the Q or quality of the electromagnetic field which in turn influences the electrical circuit of which sensor 104 is a part. The associated ignition system is designed so that the change in Q of the electromagnetic field, which occurs when the leading edge of each arm 94 is substantially in line with the longitudinal centerline of sensor 104, will cause the associated ignition system to fire or discharge a high voltage spark. It will be understood that the effect of arms 94 on the Q of the electromagnetic field depends on the area of the field which each arm 94 intercepts and on the spatial relation of each arm 94 to sensor 104.

During use, a distributor of the type shown in FIG. 6 incurs wear which produces shaft run out as described hereinabove. Such shaft run out is especially troublesome when a triggering rotor of the type shown in FIG. 6 is used because it does not have the self-compensating feature of rotor 44 shown in FIG. 1. Thus, any shaft run out is undesirable, small variations in spatial relationship of the rotor to the sensor changing the point at which firing of the ignition system occurs and large variations resulting in the ignition system not firing at all. The advantage of our invention can now be readily seen since connection of sensor 104 to rotor 90 by a bearing 110 maintains the spatial relation of sensor 104 to rotor 90 constant regardless of shaft run out.

The above detailed description is intended to be illustrative only. Our invention is subject to various modifications, changes and the like without departing from the scope and spirit of it. Consequently, the limits of our invention should be determined from the claims appended hereto.

What is claimed is:

1. For use in a conventional distributor having a breaker cam and a timing mechanism, a unitary assembly for converting the distributor to use with an electronic breakerless ignition system comprising a triggering rotor, means adapted for mounting said rotor on the cam for support and conjoint rotation, a triggering sensor, means adapted for connecting said sensor to the timing mechanism, and a bearing connecting said rotor and sensor for relative rotation and supporting said sensor from said rotor and maintaining a substantially fixed radial relationship between said rotor and sensor.

2. An assembly as set forth in claim 1 wherein said triggering rotor includes a plurality of arms arranged so that the tips of said arms pass in close proximity to said sensor during rotation of said rotor.

3. An assembly as set forth in claim 1 wherein said triggering rotor includes a plurality of arms, each arm having a slot arranged so that during rotation of said rotor said sensor intercepts said slots as said arms sweep past said sensor.

4. For use in a conventional distributor having a breaker cam, a unitary assembly for converting the distributor to use with an electronic breakerless ignition system comprising a triggering rotor, means adapted for mounting said rotor on the cam for support and conjoint rotation, a triggerng sensor, and a bearing connecting said rotor and sensor for relative rotation and supporting said sensor from said rotor and maintaining a substantially fixed radial relationship between said rotor and sensor.

5. A method for converting a conventional distributor having a breaker cam, a timing mechanism and a breaker point plate assembly to use with an electronic ignition system comprising the steps of removing the breaker point plate assembly from the distributor, mounting on the breaker cam a unitary assembly having a rotor, a sensor and a bearing connecting the rotor and sensor for relative rotation and maintaining a substantially fixed radial relationship between said rotor and sensor, said mounting being such that the rotor is connected to the cam for conjoint rotation, and connecting the sensor to the timing mechanism.

* * * * *